US006857970B2

(12) United States Patent
Robbins

(10) Patent No.: US 6,857,970 B2
(45) Date of Patent: Feb. 22, 2005

(54) GOLF TRAINING APPARATUS AND METHOD OF USE

(76) Inventor: John Robbins, 3910 S. Alberly Way, Salt Lake City, UT (US) 84124

( * ) Notice: Subject to any disclaimer, the term of this patent is extended or adjusted under 35 U.S.C. 154(b) by 0 days.

(21) Appl. No.: 10/423,430

(22) Filed: Apr. 24, 2003

(65) Prior Publication Data

US 2004/0214652 A1 Oct. 28, 2004

(51) Int. Cl.[7] ..... A63B 53/06

(52) U.S. Cl. ..... 473/276; 473/201; 473/409; 473/227

(58) Field of Search ..... 473/216, 223, 473/226, 227, 229, 238, 257, 266, 268, 276, 277

(56) References Cited

U.S. PATENT DOCUMENTS 2,706,635 A * 4/1955 Stephenson ..... 473/229
3,298,693 A 1/1967 Eisenberg
4,880,240 A 11/1989 Lewis
5,156,401 A 10/1992 Hodgkiss
D344,207 S 2/1994 Bauman
D347,457 S 5/1994 Armstrong, III
5,413,329 A * 5/1995 Hirsch ..... 473/238
5,658,204 A 8/1997 Nappi
5,665,007 A 9/1997 Tatum
6,471,598 B2 * 10/2002 Takase ..... 473/212

* cited by examiner

*Primary Examiner*—Gregory Vidovich
*Assistant Examiner*—Nini F. Legesse
(74) *Attorney, Agent, or Firm*—Thorpe North & Western, LLP

(57) ABSTRACT

A method and apparatus providing a golf training apparatus configured to aid a golfer in developing a consistent golf swing. The golf training apparatus includes a triangle plane guide, a shaft coupler and a limb attachment member. The triangle plane guide includes two side members and a top member coupled to each other to form a triangular configuration. The shaft coupler is operatively coupled to a portion of the triangle plane guide and is operable to removably couple with a shaft of the golf club below a grip end of the shaft so that said triangle plane guide is disposed in a suspended position above the shaft. The limb attachment member is coupled to the triangle plane guide and operable to attach to a limb of the golfer in an adjustable manner. With this arrangement, the triangle plane guide is operable to provide a visual reference while addressing a golf ball in a golf stance, wherein the visual reference includes (i) visual alignment from an apex of the two side members down the shaft toward the golf ball and (ii) visual alignment of the top member with a distant target.

15 Claims, 5 Drawing Sheets

GOLF TRAINING APPARATUS AND METHOD OF USE

FIELD OF THE INVENTION

The present invention relates generally to golf training devices. More particularly, a training apparatus and method that visually aids a golfer to develop a more consistent golf swing.

STATE OF THE ART

Golf is a game of skill and consistency that requires demanding hand-eye coordination with accurate timing in order to be successful. Some golfers have the athletic skill to pick up the game quickly and be successful. Most golfers, new and old alike, struggle with swing timing and consistency. A variety of training aids have been developed to teach consistency and proper timing and have met with some success.

For example, one training device includes a pair of circular frames mounted on a support stand. The circular frames have a radius less than the length of a typical golf club and are tilted at about a 45–60 degree angle. The golfer stands within the circular frames at the approximate center point, allowing the circular frames or rings to define a proper swing plane while swinging the golf club. The club head extends beyond the perimeter of the rings such that the rings guide the club head on a defined path as the golfer practices his or her swing. There are several problems that exist with this device. Firstly, the training aid is designed for use with full swings and not for partial swings or putts. Secondly, the device is large and cumbersome and cannot be transported easily from one location to another. The ability to take the training aid to the golf course for practice is always desirable. Lastly, the device gives only tactile feel to the golfer and not a visual reference of the proper swing.

Another popular training aid is a golf club with a weighted head end and an oddly angled shaft, which claims to cause the student to swing in a desired plane because of the physics of the golf club device. This training aid also has limitations. One is that the student cannot strike golf balls with the club. Secondly, it is designed for grooving a full swing, not a partial swing or for putting practice. Thirdly, it gives no visual indication of what looks right to the student when the golfer swings the club.

Another training device includes a solid grip end that has a soft ball tied to it by a length of cord. The student swings the ball and develops timing with the cord and ball to develop a consistent swing. This device has the same limitations as previously described. The club cannot be used to strike a ball. The device is used to train for full swings only. The device cannot aid the student in improving putting. Other training devices and systems are also available.

What is fundamental in a consistent golf swing is to position the arms and shoulders in a symmetrical triangle while addressing the golf ball in a golf stance and reverting back with the symmetrical triangle at the point of contacting the golf ball while swinging the golf club. This symmetry facilitates a golf swing in which the golf club strikes the ball with a square face, thereby, striking the golf ball in a desired path towards the intended target. Obtaining this symmetry in a golf swing can be very difficult and has alluded many golfers in their efforts to obtain consistent symmetry in their golf swing.

Accordingly, what is needed is a golf training aid that is inexpensive, easy to use, can readily be taken to the golf course for practice as well as helping to develop symmetry in the golf swing of the golfer.

SUMMARY OF THE INVENTION

The present invention relates to a method and apparatus providing a golf training apparatus configured to aid a golfer in developing a consistent golf swing. The golf training apparatus includes a triangle plane guide, a shaft coupler and a limb attachment member. The triangle plane guide includes two side members and a top member coupled to each other to form a triangular configuration. The shaft coupler is operatively coupled to a portion of the triangle plane guide and is operable to removably couple with a shaft of the golf club below a grip end of the shaft so that said triangle plane guide is disposed in a suspended position above the shaft. The limb attachment member is coupled to the triangle plane guide and operable to attach to a limb of the golfer in an adjustable manner. With this arrangement, the triangle plane guide is operable to provide a visual reference while addressing a golf ball in a golf stance, wherein the visual reference includes (i) visual alignment from an apex of the two side members down the shaft toward the golf ball and (ii) visual alignment of the top member with a distant target.

In another embodiment, the golf training apparatus includes a triangle plane guide and a shaft coupler. The triangle plane guide includes two side members and a top member coupled to each other to form a triangular configuration. The shaft coupler is operatively coupled to a portion of the triangle plane guide and is operable to be removably fixed to a shaft of the golf club below a grip end of the shaft so that said triangle plane guide is disposed in a suspended position above the shaft of the golf club.

Other features and advantages of the present invention will become apparent to those of ordinary skill in the art through consideration of the ensuing description, the accompanying drawings, and the appended claims.

BRIEF DESCRIPTION OF DRAWINGS

While the specification concludes with claims particularly pointing out and distinctly claiming that which is regarded as the invention, the advantages of this invention may be ascertained from the following description of the invention when read in conjunction with the accompanying drawings, in which:

FIG. 1(*a*) illustrates a sectional perspective view of the golf training apparatus, depicting components of the golf training apparatus in a dissembled position, according to another embodiment of the present invention;

DETAILED DESCRIPTION OF THE INVENTION

Figure 1:
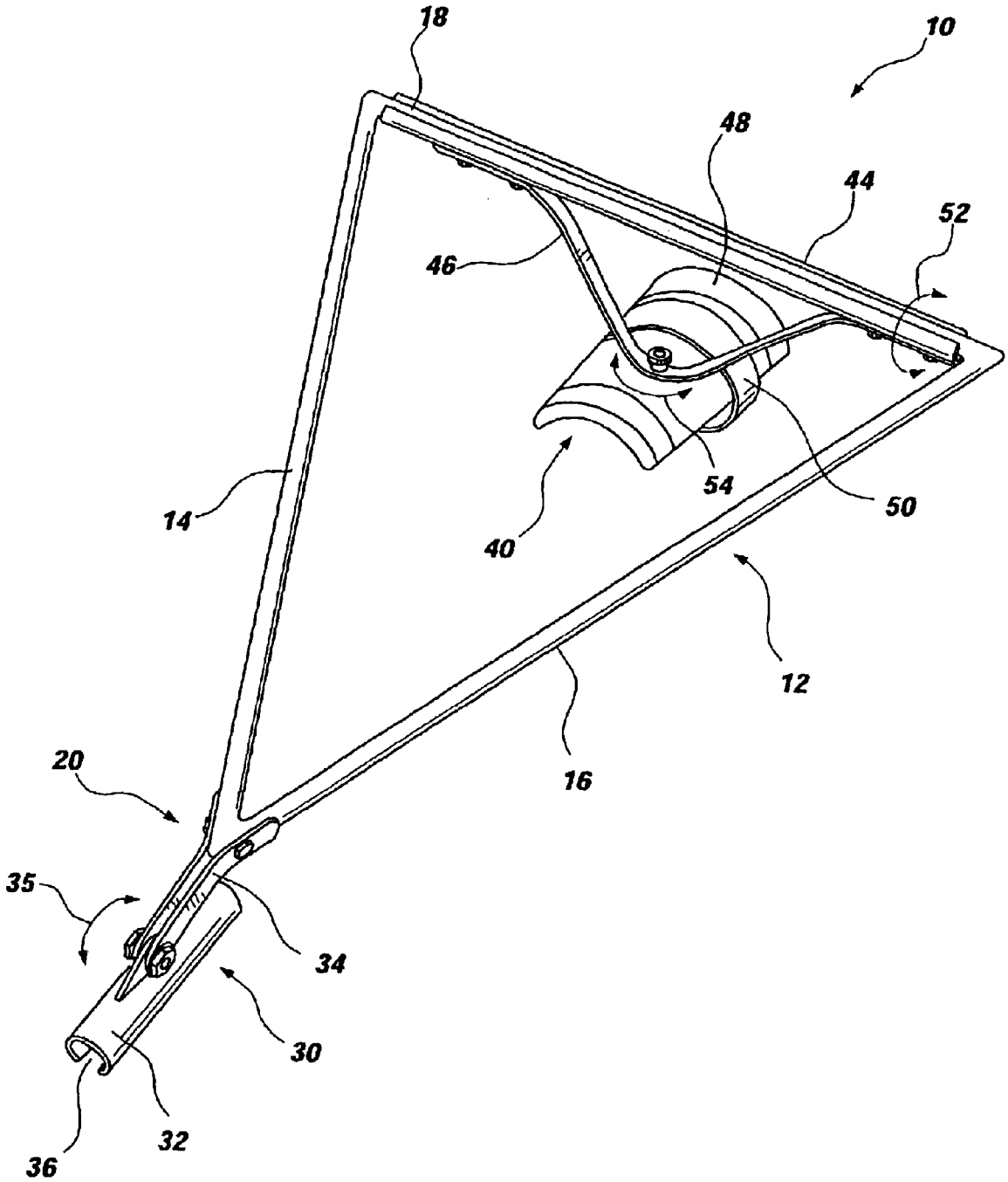
FIG. 1 illustrates a perspective view of the golf training apparatus, according to an embodiment of the present invention.
Figure 1A:
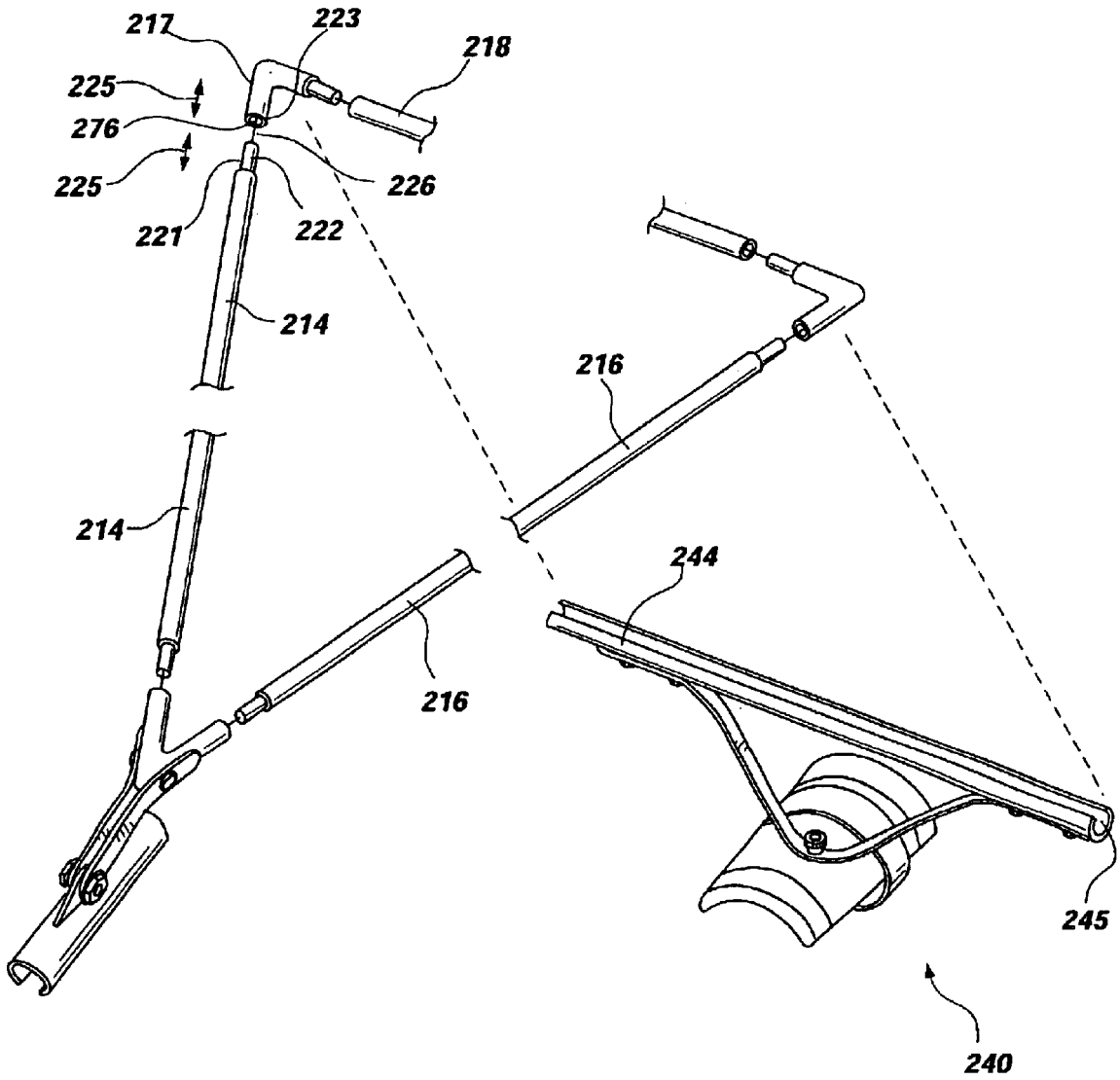

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
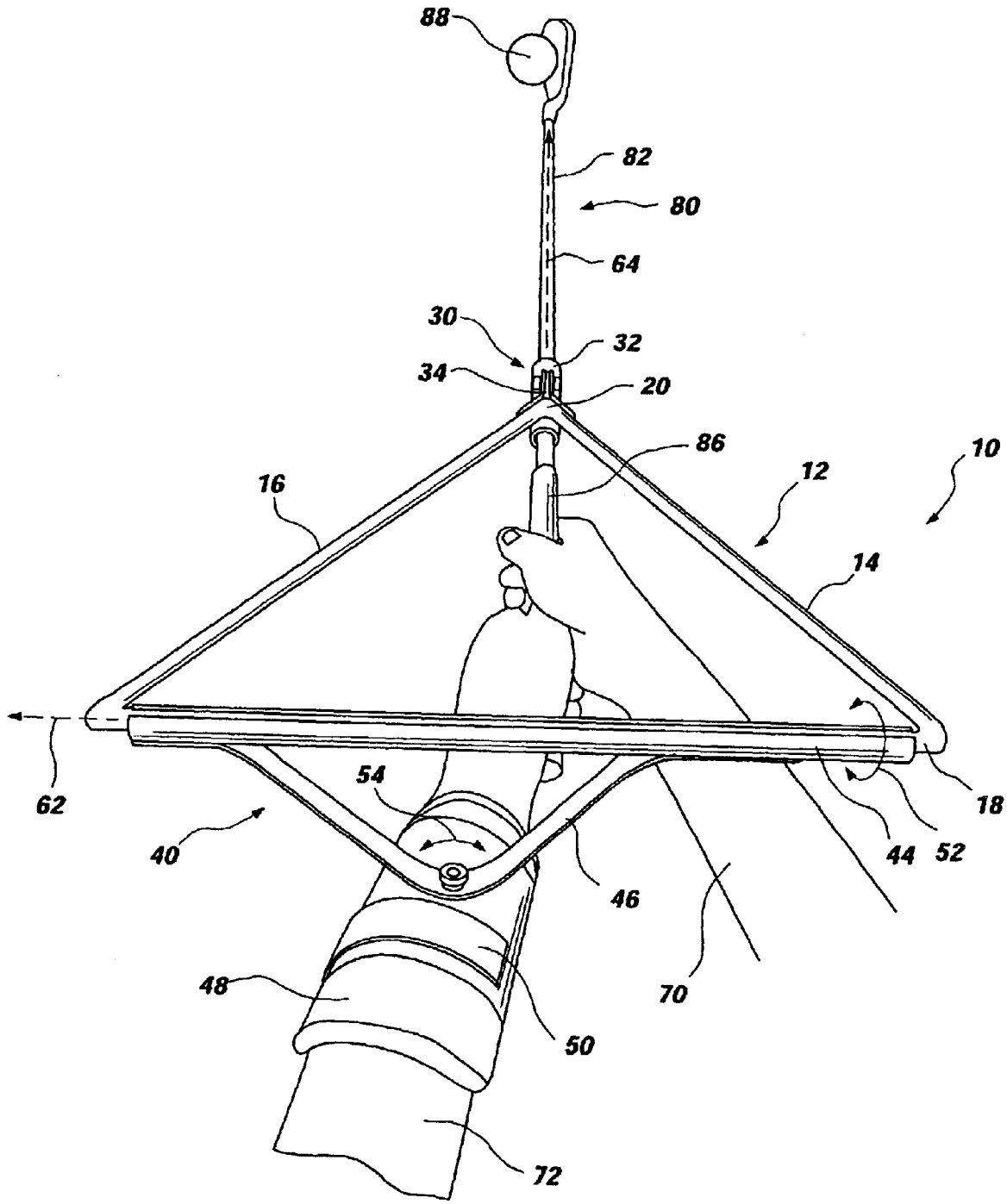
FIG. 2 illustrates a top perspective view of the golf training apparatus, depicting a golfer's view of the golf training apparatus attached to the golf club held by the golfer while addressing a golf ball in a golf stance.

FIGS. 1 and 2 illustrate a golf training apparatus 10 according to an embodiment of the present invention. In this embodiment, the golf training apparatus 10 includes a triangle plane guide 12 operatively coupled to a shaft coupler 30 and a limb attachment 40. The shaft coupler 30 is configured to couple to a shaft 82 of a golf club 80 and the limb attachment 40 is configured to attach to a limb 72, such as a forearm, of a golfer 60. With this arrangement, the triangle plane guide 12 is suspended above the shaft 82 when a golfer 70 holds the golf club 80 in a golf stance.

The triangle plane guide 12 is viewable by the golfer 70 and operable to simulate a triangular position of the golfer's arms and shoulders while addressing the golf ball 88 in the golf stance and while striking the golf ball 88 during a golf swing. As such, the triangle plane guide 12 provides a visual reference readily viewable by the golfer 70 in the golf stance. The golfer 70 can then swing at the golf ball 88 and view and identify a position of the triangle plane guide 12 at the point of striking the golf ball 88. For a proper golf swing, such position of the triangle plane guide 12 at the point of striking the ball 88 should be substantially the same as the position of the triangle plane guide 12 while in the golf stance. The golfer 70 can then adjust and conform the golf swing with respect to the visual reference previously viewed in the golf stance to obtain a proper golf swing. The golf training apparatus 10 can be utilized with any of the various golf clubs, such as a putter, any of the irons and/or the woods and can be utilized with the various golf strokes and swings associated with the various golf clubs.

The triangle plane guide 12 is formed by a first side member 14, a second side member 16 and a top member 18. The first and second side members 14 and 16 can generally be of equal length. The top member 18 can be shorter than, or equal to, the length of the first and second side members 14 and 16, however, the top member 18 can also include a longer length than the first and second side members 14 and 16. Each of the first and second side members 14 and 16 and the top member 18 can be fixedly coupled to ends or portions of each other to form the triangle plane guide 12 in a triangular configuration. The triangle plane guide 12 can be made from any suitable material or combination of materials, such as polymeric type materials, fiberglass, graphite, resins, steel, aluminum, wood, titanium or any other suitable materials that are light weight, easy to manufacture and durable.

The shaft coupler 30 is operatively coupled to the triangle plane guide 12. The shaft coupler 30 can include an extension 34 and a sleeve member 32. The extension 34 can be configured to be fixed to and extend from an apex 20 defined by the junction of the first and second side members 14 and 16 with the sleeve member 32 rotatably coupled to the extension 34, as indicated by arrow 35. Such an extension 34 can be coupled to the triangle plane guide 12 with any suitable means, such as fasteners or any other suitable coupling, such as ball and socket type couplings. The sleeve member 32 can define a slot 36 therein which is sized and configured to removably receive a shaft 82 of a golf club 80. Such a sleeve member 32 can be sized to allow sliding movement therein. The sleeve member 32 can include a padded inner liner or be made of a material that will substantially prevent scratches to the finish of the shaft 82 of the golf club 80. In another embodiment, it is contemplated that the sleeve member can also removably clamp around the shaft 82 in a fixed position. The extension 34 and sleeve member 32 can be made from any suitable material or combination of materials, such as polymeric type materials, fiberglass, graphite, resins, steel, aluminum, wood, titanium or any other suitable materials that are light weight, easy to manufacture and durable.

The limb attachment 40 can include a limb holder 48, which is operatively coupled to the triangle plane guide 12 through an attachment means. Such attachment means can be any suitable means for interconnecting the limb holder 48 to the triangle plane guide 12. For example, the attachment means can include a top sleeve 44 and an extension member 46. The top sleeve 44 can be rotatably coupled to the top member 18 so as to allow the top sleeve 44 to freely rotate about the top member 18, as indicated by arrow 52. The extension member 46 can fixedly extend from the top sleeve 44 with the limb holder 48 rotatably coupled thereto, as indicated by arrow 54. With this arrangement, the limb holder 48 can be configured to receive a limb 72 of a golfer 70, such as a forearm, in an adjustable manner. The interior of the limb holder 48 can be generally padded for the comfort of the golfer 70. Such limb holder 48 can also include a strap 50 that can be buckled or attached with Velcro or the like to allow the golfer 70 to readily fasten the limb holder 48 to the forearm at a desired tightness as well as allow the golfer 70 to easily remove the limb holder 48. In another embodiment, it is contemplated that the extension member can extend toward the grip 86 with an attachment member that can be integrated to removably couple with the wrist, fingers or hand of the golfer or even be integrated with the grip 86 of the golf club 80.

As previously set forth, the extension member 46 coupled between the top sleeve 44 and the limb holder 48 allows rotational movement as indicated by respective rotational arrows 52 and 54. In this manner, the limb attachment 40 can be rotatable about two axes substantially perpendicular to one another: one axis being defined by the top member 18 with the rotation of arrow 52; and, the other axis being defined where the limb holder 48 rotatably attaches to the extension member 46 with the rotation of arrow 54. Such rotational movement provides the golfer 70 with substantially unrestricted movement while swinging the golf club 80. Furthermore, the rotational movement of the shaft coupler 30 and the limb attachment 40 allows the triangle plane guide 12 to be flipped-over so that right-handed and left-handed golfers can equally use the golf training apparatus 10.

With reference to FIG. 1(*a*), in another embodiment, the golf training apparatus 210 can be disassembled into smaller components so that the golf training apparatus 210 can be readily placed in ones golf bag. In particular, the top sleeve 244 of the arm attachment 240 can include a slot 245 along the longitudinal length thereof to, thereby, facilitate ready removal and re-attachment of the arm attachment 240 with respect to the top member 218 of the triangle plane guide 212. Further, the triangle plane guide can be formed with a tubular configuration with end portions of each of the top member 218 and the first and second side members 214 and 216 of the triangle plane guide 212 being separatable with respect to each other. For example, at one end portion of the first side member 214, the end portion can be separated and re-joined at first and second joints 221 and 223 in a telescopic manner as indicated by arrows 225. The first joint 221 can include an insert portion 222 extending longitudinally therefrom and having a tubular configuration with an outer diameter than can be slidingly positioned within and removed from a tubular opening 226 at the second joint 223. In this manner, the second joint 223 can receive the insert portion 222 in the tubular opening 226 to secure the first and second joints 221 and 223 with an interference fit as well as be slidingly separated to disassemble the triangle plane guide 212. Likewise, a similar arrangement can be implemented at each of the end portions of the first and second side members 214 and 216 and the top member 218 to facilitate ready disassembly and assembly of the triangle plane guide 212. In addition, a line member 224 having an elasticity characteristic can extend through the tubular configuration of each of the first and second side members 214 and 216 and the top member 218 of the triangle plane guide 212. As such, when disassembling the triangle plane guide 212, the triangle plane guide 212 is maintained together to prevent losing the disassembled components of the triangle plane guide 212. Further, such line member 224 facilitates ready assembly of the triangle plane guide 212 with each of the components in ordered position along the line member 224 for assembly. With this arrangement, the golf training apparatus 210 can be readily assembled for use and disassembled for storing in, for example, a golf bag.

With respect to FIG. 2, there is depicted the golf training apparatus 10 attached to the golfer and golf club 80 from a top perspective view as the golfer 70 views the apparatus 10 while in the golf stance. From the view of the golfer 70, the triangle plane guide 12 is suspended above the shaft 82 and provides an inverted isosceles triangle with the shaft coupler 30 at the apex 20 of the triangle plane guide 12. The triangle plane guide 12 is disposed in a suspended position over the shaft 82 of the golf club 80. Such a triangle plane guide 12 is configured to mimic the triangle formed by the golfer's shoulders and arms in the golf stance. The triangle plane guide 12 is operable to provide a visual reference to visually aid the golfer 70 in identifying where the golfer's arms and shoulders are positioned in the golf stance and while swinging the golf club 80 at the instant of impact with the golf ball 88.

In particular, when a golfer 70 addresses the golf ball 88 in the golf stance, the golfer should form a triangular configuration with the golfer's arms and shoulders, where the arms form a V-configuration pointing downward toward the golf ball 88 and the shoulders are aligned with a distant target. With the triangle plane guide 12 suspended above the golf shaft 82, the golfer 70 can adjust the orientation of the triangle plane guide 12, which inherently adjusts the arms and shoulders of the golfer 70. Such adjusting includes visually aligning the top of the triangle plane guide 12 with a target reference 62 and with a striking point reference 64.

Specifically, obtaining the proper target reference 62 includes visually aligning the top member 18 of the triangle plane guide 12 with a distant target so that the longitudinal axis of the top member 18 is directed toward the distant target and substantially parallel with the ground the golfer 70 is standing on. The proper striking point reference 64 is obtained by visually aligning the apex 20 of the first and second side members 14 and 16 down the shaft 82 of the golf club 80 toward the golf ball 88.

With the striking point reference 64 and the target reference 62 each properly aligned, the golfer 70 has obtained a proper golf stance with the arms and shoulders in the triangular configuration. The golfer 70 can then view the triangle plane guide 12 to obtain a visual reference of the orientation of the triangle plane guide 12. In this manner, the triangle plane guide 12 provides the golfer with a means to view and identify the position of the golfer's arms and shoulders in determining if the arms and shoulders are symmetrically forming the triangular configuration in a proper golf stance. Repeating such process of symmetrically aligning the triangle plane guide 12 with the target reference 62 and striking point reference 64 with a proper golf stance can assist the golfer to conform, acclimate and memorize such proper golf stance so that this proper golf stance becomes the natural golf stance of the golfer 70.

Figure 3:
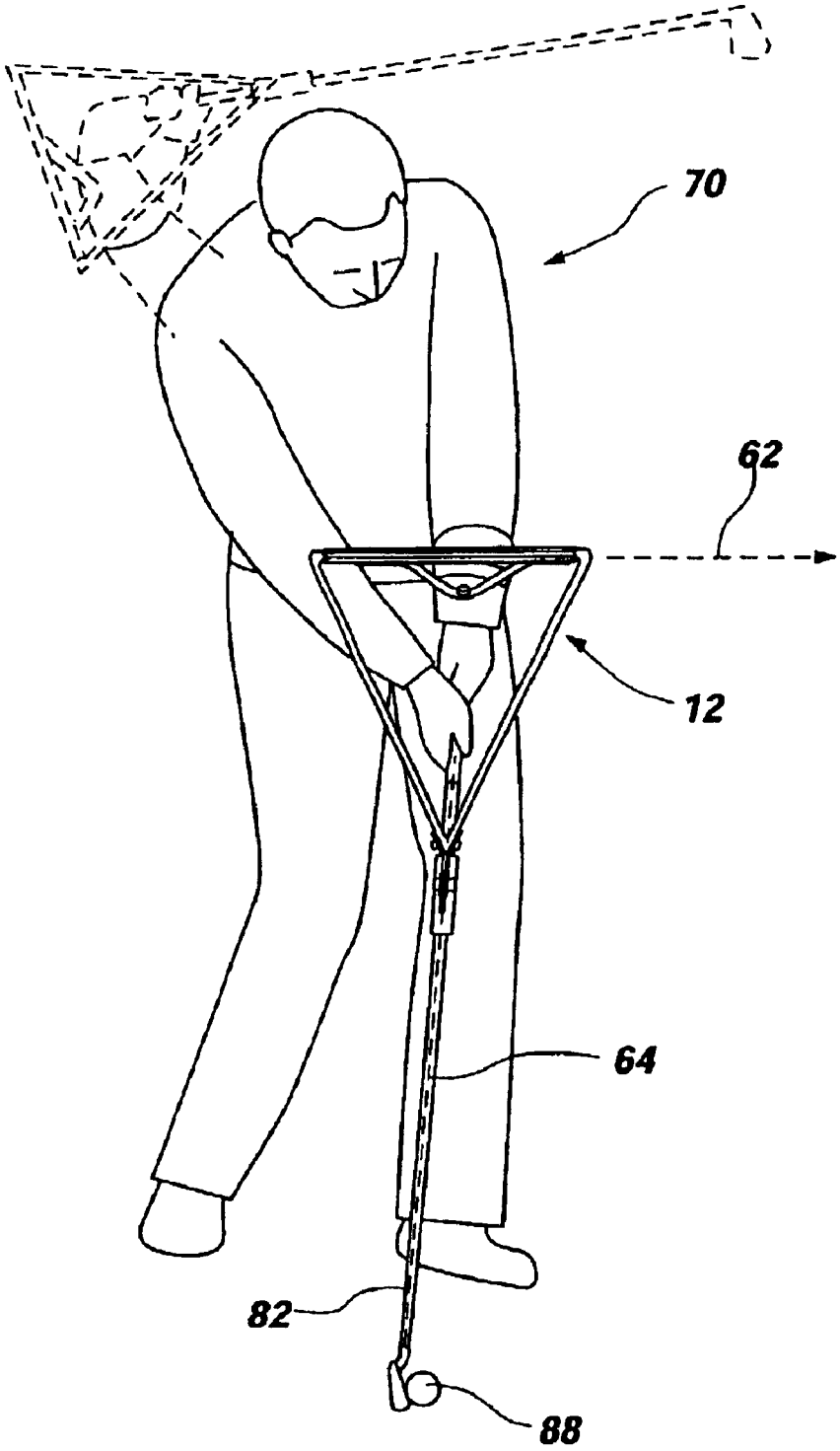
FIG. 3 illustrates a front view of a golfer with the golf training apparatus attached to the golfer, depicting the golfer swinging a golf club with the back swing position and forward position shown in outline and depicting the golfer having a frame of reference from the golf training apparatus at the point of impact with the golf ball.

Referring now to FIGS. 2 and 3, as previously set forth, once the golfer 70 is in the proper golf stance, the golfer can obtain a visual reference of the orientation of the triangle plane guide 12. The golfer 70 can then swing at the golf ball 88, taking a back swing and then swinging forward toward the golf ball 88 or striking point. When striking the golf ball 88, the golfer 70 can view the orientation of the triangle plane guide 12. At the instant of striking the golf ball 88, a proper golf swing will exhibit the triangle plane guide 12 in substantially the same position as was positioned in the golf stance. As such, the golfer 70 can then identify a position or orientation of the triangle plane guide 12 at the instant of striking the golf ball 88. The golfer 70 can then take additional swings to adjust and conform, if needed, the golfer's swing so that the orientation of the triangle plane guide 12 is substantially oriented the same as the orientation of the visual reference of the triangle plane guide 12 previously viewed in the golf stance.

Once the golfer 70 determines how to adjust and conform the golfer's swing to revert back to the orientation as previously viewed in the golf stance, the golfer will obtain a proper golf swing with more symmetrical swing with consistent results. Such proper golf swing can be repeated until the golfer 70 conforms and acclimates to the proper swing until the proper swing becomes part of the golfer's natural swing. In this manner, the visual reference obtained from the triangle plane guide 12 while in the golf stance enables the golfer 70 to identify any divergence from such visual reference while striking the golf ball 88 during a golf swing, thereby, allowing the golfer 70 to identify such divergence and make corrections accordingly.

The golf training apparatus 10 is advantageous in that it provides a clear visual reference along with tactile feel during a golf swing since the apparatus 10 becomes part of the golfer 70 while practicing. Further, the triangle plane guide 12 serves as a visual reference that aids the golfer 70 in identifying the position of the triangular configuration formed by the arms and shoulders of the golfer 70 in the golf stance as well as at the instant of striking the golf ball 88. As such, when a golfer 70 identifies from the orientation of the triangle plane guide 12 that the golfer's arms and shoulder's are out of proper position, the golfer can conform the golfer's golf stance and swing so that such arms and shoulders are in proper position. In this manner, the triangle plane guide 12 serves to aid the golfer 70 in memorizing and acclimating to a proper golf stance and golf swing so that the golfer 70 can obtain more consistent results. As previously indicated, the golf training apparatus 10 can be utilized for a putting stroke, chip and pitching strokes or full golf swings with the longer irons and woods.

Figure 4:
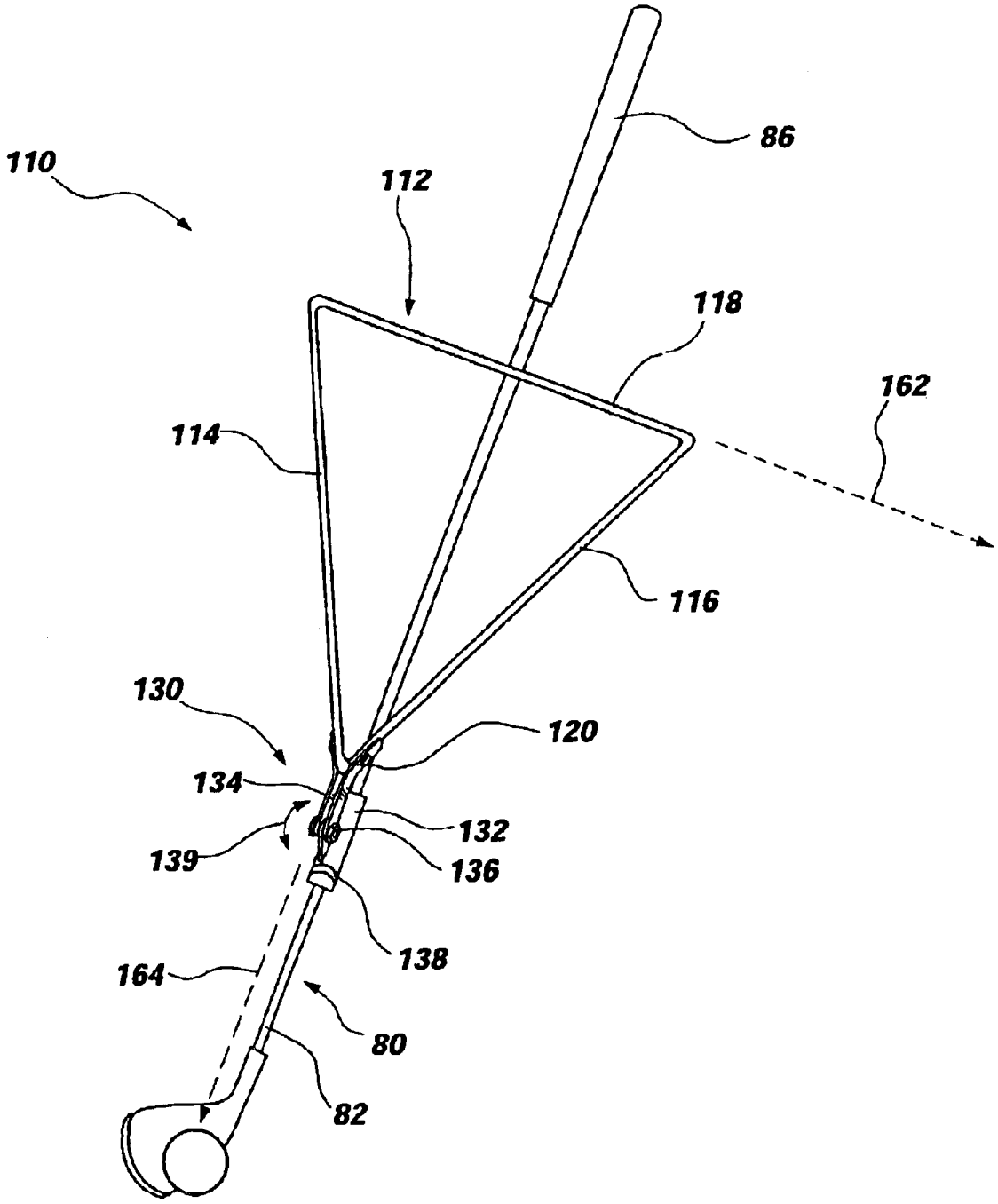
FIG. 4 illustrates a perspective view of a golf training apparatus, depicting the golf training apparatus attached to a shaft of a golf club, according to another embodiment of the present invention.

FIG. 4 illustrates another embodiment of a golf training apparatus 110. In this embodiment, the golf training apparatus 110 is substantially the same as the previous embodiment, except the golf training apparatus 110 of this embodiment does not include the limb attachment. In particular, the golf training apparatus 110 includes a triangle plane guide 112 having a shaft coupler 130 operatively coupled thereto. The triangle plane guide 112 includes first and second side members 112 and 114 and a top member 118 each coupled together to form the triangle plane guide 112 in a triangular configuration.

The shaft coupler 130 can include an extension 134 and a sleeve member 132. The extension 134 can be fixed at one end to an apex 120 of the first and second side members and rotatably coupled to the sleeve member 132 by a rotatable coupling 136. The sleeve member 132 can include a slot defined therein configured to receive the shaft 82 of the golf club 80. In this embodiment, the sleeve member 132 is configured to removably receive the shaft 82 in a fixed position via a clamp 138 or any other suitable device for fixing the sleeve member 132 to the shaft 82. Such sleeve member 132 can include padding at an interior of the sleeve member 132 or be made from a non-abrasive material that will substantially prevent scratches to the shaft 82 of the golf club 80.

In this embodiment, the rotable coupling 136 is configured to be fixedly rotatable in various positions, as indicated by arrow 139, depending on the angle the golfer desires to view the triangle plane guide 112. Such rotatable coupling 136 can be configured to rotate to multiple rotational positions by any suitable fixedly rotational means, such as, a rotate and click-in mechanism to fix the triangle plane guide 112 to a desired angle. In another embodiment, the rotatable coupling 136 can be implemented between the extension 134 and the apex 120 of the first and second side members 114 and 116. In this case, the coupling between the extension 134 and the sleeve member 132 can be a fixed coupling.

With this arrangement, the triangle plane guide 112 can be positioned on the shaft 82 in an adjustable manner via the clampable sleeve member 132. As in the previous embodiment, the triangle plane guide 112 in this embodiment provides a visual reference viewable and identifiable by the golfer by visually aligning the top member 118 with a distant target to obtain a target reference 162 and visually aligning the apex 120 of the first and second side members 114 and 116 down the shaft 82 toward the golf ball 88 to obtain the striking point reference 164. With the target reference 162 and the striking point reference 164 properly aligned, the triangle plane guide 112 provides a visual reference to aid the golfer in obtaining a proper golf stance with the golfer's arms and shoulders in a triangular configuration. As previously set forth, the golfer can then swing the golf club 80 to identify the orientation of the triangle plane guide 112 at the instant of striking the golf ball 88 and, then, take additional golf swings to adjust such golf swing so that the triangle plane guide 112 substantially matches the previously obtained visual reference at the instant of striking the golf ball 88.

While the present invention has been disclosed in terms of exemplary embodiments and variations thereof, those of ordinary skill in the art will recognize and appreciate that the invention is not so limited. Those of ordinary skill in the art will recognize and appreciate that many additions, deletions and modifications to the disclosed embodiments and their variations may be implemented without departing from the scope of the invention, which is limited only by the appended claims and their legal equivalents.

What is claimed is:

1. A golf training apparatus configured to aid a golfer in developing a consistent golf swing, comprising:

a triangle plane guide having two side members and a top member coupled to each other to form a triangular configuration;

a shaft coupler operatively coupled to a portion of said triangle plane guide, said shaft coupler being operable to removably couple with a shaft of the golf club below a grip end of the shaft so that said triangle plane guide is disposed in a suspended position above the shaft; and a limb attachment member coupled to said triangle plane guide and operable to attach to a limb of the golfer in an adjustable manner;

wherein said triangle plane guide is operable to provide a visual reference while addressing a golf ball in a golf stance, said visual reference including (i) visual alignment from an apex of said two side members down the shaft toward the golf ball and (ii) visual alignment of the top member with a distant target.

2. The golf training apparatus according to claim 1, wherein said triangle plane guide is operable to be viewed while striking the golf bail during a golf swing to aid the golfer to identify and conform a position of said triangle plane guide while striking the golf bail with respect to said visual reference of said triangle plane guide previously viewed while in the golf stance.

3. The golf training apparatus according to claim 1, wherein said triangle plane guide is viewable by the golfer and operable to simulate a triangular position of arms and shoulders of the golfer while in the golf stance and while striking the golf ball during a golf swing.

4. The golf training apparatus according to claim 1, wherein said limb attachment member includes a strap to removably secure said limb attachment member to the limb of the golfer.

5. The golf training apparatus according to claim 1, wherein said limb attachment member is rotatable about an extension member coupling said limb attachment member to said triangle plane guide.

6. The golf training apparatus according to claim 1, wherein said limb attachment member rotatably couples to said top member of said triangle plane guide.

7. The golf training apparatus according to claim 1, wherein said shaft coupler is pivotally coupled to said triangle plane guide so that the shaft can be disposed in said shaft coupler at an angle suitable to the golfer.

8. The golf training apparatus according to claim 1, wherein said shaft coupler comprises a sleeve member operable to receive the shaft of the golf club.

9. The golf training apparatus according to claim 8, wherein said sleeve member is operable to slidingly hold the shaft of the golf club.

10. The golf training apparatus according to claim 8, wherein said sleeve member is operable to be removably fixed to the shaft of the golf club.

11. A method to aid a golfer in developing a consistent golf swing, the method comprising:

providing a golf training apparatus including a triangle plane guide having two side members and a top member coupled to each other to form a triangular configuration, said golf training apparatus including a shaft coupler and a limb attachment member each operatively coupled to a portion of said triangle plane guide;

coupling said shaft coupler to a portion of a shaft of the golf club below a grip end of the shaft;

attaching said limb attachment member to a limb of the golfer;

gripping the grip end of the shaft and addressing a golf ball in a golf stance so that said triangle plane guide is suspended above the shaft of the golf club with the top member substantially parallel with the ground and said two side members extending downward to define an apex;

visually aligning said top member of the triangle plane guide with a distant target and visually aligning said apex of said two side members with the shaft toward the golf ball so that said triangle plane guide provides a visual reference with the distant target and the golf ball; and swinging the golf club at the golf ball with said triangle plane guide in view of the golfer while striking the golf ball.

12. The method of claim 11, wherein said swinging comprises viewing said triangle plane guide while striking the golf ball to resume a position of said triangle plane guide with respect to said visual reference of said triangle plane guide as previously viewed while in the golf stance.

13. The method of claim 12, wherein said viewing comprises conforming said swinging so that while striking the golf ball said triangle plane guide is positioned to substantially match said visual reference of said triangle plane guide previously viewed while in the golf stance.

14. The method of claim 13, wherein said conforming comprises repeating said conforming to acclimate said swinging to a proper swing plane.

15. The method of claim 11, wherein said aligning comprises viewing said triangle plane guide to identify a triangular position of arms and shoulders of the golfer and adjusting the arms and shoulders with respect to said aligning of the triangle plane guide to the golf ball and the distant target.

* * * * *